US007347606B1

(12) United States Patent
Patten

(10) Patent No.: US 7,347,606 B1
(45) Date of Patent: Mar. 25, 2008

(54) ROPE LIGHT TRACK SYSTEM

(76) Inventor: Gregg M. Patten, 2119 Barr St., Suite D, Houston, TX (US) 77080

( * ) Notice: Subject to any disclaimer, the term of this patent is extended or adjusted under 35 U.S.C. 154(b) by 216 days.

(21) Appl. No.: 11/157,721

(22) Filed: Jun. 20, 2005

Related U.S. Application Data

(60) Provisional application No. 60/581,170, filed on Jun. 18, 2004.

(51) Int. Cl.
*F21V 29/00* (2006.01)
*F21V 7/04* (2006.01)
*F21S 4/00* (2006.01)

(52) U.S. Cl. ..... 362/565; 362/152; 362/249; 362/252; 362/217; 362/267

(58) Field of Classification Search ..... 362/551, 362/555, 554, 565, 582, 495, 146, 152, 153, 362/153.1, 249, 252, 251, 217, 219, 222, 362/223, 267, 285, 806
See application file for complete search history.

(56) References Cited

U.S. PATENT DOCUMENTS

| | | | | |
|---|---|---|---|---|
| 2,920,184 | A | 1/1960 | Kessler | |
| 3,500,036 | A | 3/1970 | Szentveri | |
| 3,663,808 | A | 5/1972 | Baatz | |
| 4,600,975 | A * | 7/1986 | Roberts | 362/147 |
| 4,945,675 | A | 8/1990 | Kendrick | |
| 5,499,170 | A | 3/1996 | Cagne | |
| 5,680,496 | A * | 10/1997 | Burkitt et al. | 385/100 |
| 6,065,853 | A | 5/2000 | Crevier | |
| 6,123,443 | A | 9/2000 | Conway | |
| 6,354,714 | B1 | 3/2002 | Rhodes | |
| 6,523,986 | B1 * | 2/2003 | Hoffmann | 362/576 |
| 6,655,824 | B2 * | 12/2003 | Tufte | 362/505 |
| 6,699,137 | B2 | 3/2004 | Szymanski | |
| 6,817,731 | B2 * | 11/2004 | Tufte | 362/223 |
| 7,114,826 | B1 * | 10/2006 | Lilly | 362/146 |

* cited by examiner

*Primary Examiner*—Jacob Y. Choi
(74) *Attorney, Agent, or Firm*—Kenneth A. Roddy

(57) ABSTRACT

A rope light track system houses a tubular flexible rope light string and can be mounted on or in various interior and exterior structures to protect the light string from damage and provide utilitarian and decorative lighting. The system includes a plurality of elongate rigid or semi-rigid tracks having a longitudinal generally rectangular U-shaped retention channel with an open end defined by laterally opposed side walls adjoined at one end by a transverse base wall and at least one retainer element near the open end. The tracks have side portions or a mounting flange portion extending outwardly from the retention channel to accommodate various mounting configurations. An elongate tubular flexible rope lighting string is removably mounted in the retention channel and retained therein to prevent accidental removal, and is disposed below the channel open end to protect it from being damaged and allow light emanating therefrom to be directed out of the channel open end. Various control devices control the illuminating operation of the rope light string.

11 Claims, 3 Drawing Sheets

ROPE LIGHT TRACK SYSTEM

CROSS REFERENCE TO RELATED APPLICATION

This application claims priority of U.S. Provisional Patent Application Ser. No. 60/581,170, filed Jun. 18, 2004, the pendency of which is extended until Jun. 20, 2005 under 35 U.S.C. 119(e)(3).

BACKGROUND OF THE INVENTION

1. Field of the Invention

This invention relates generally to flexible strip lighting fixtures and systems, and more particularly to a rope light track system that houses a tubular flexible rope light string and can be mounted on or in various interior and exterior structures to protect the light string from damage and provide utilitarian and decorative lighting.

2. Background Art

Flexible lighting strips such as "rope lights", "flexible neon rope", and "fiber optic" strips, are known in the art, and are commonly used for lighting both interior and exterior structures and for decorative applications. Typically, these types of flexible lighting strips comprise a plurality of closely spaced electrically connected miniature light bulbs or light emitting diodes (LED's) to form elongate strings, or elongate side-lit fiber optic cable, which are encased in an elongate hollow flexible translucent tube.

Although the flexible tube allows users to configure these types of flexible lighting strips or rope lights into various configurations with ease, it also reduces the structural strength of the lighting string, and limits the areas in which they may be installed. For example, if used to border a driveway, walkway, or stairway, they may be crushed by the wheel of a vehicle, or may be stepped on; or if placed on a handrail, they may be become twisted or deformed, resulting in damaged bulbs LED's, or fibers, or short circuiting or the wiring in the flexible tube.

There are several patents that disclose various lighting track systems for housing and mounting elongate strings of miniature light bulbs and light emitting diodes (LED's), or fiber optic cable.

Kessler, U.S. Pat. No. 2,920,184 discloses an illuminated driveway curbing consisting of an inverted U-shaped cover made of transparent plastic adapted to house illuminating means. The cover projects light upwardly over a complete 180° angle and is bolted onto the surface of a flat driveway.

Szentveri, U.S. Pat. No. 3,500,036 discloses a strip lighting device in which bores must be formed to accommodate a socket and a lamp.

Baatz, U.S. Pat. No. 3,663,808 discloses an illuminated safety curbing construction which includes a plastic cover mounted on a rigid base structure which is adapted to be bolted above a flat surface.

Kendrick, U.S. Pat. No. 4,945,675 discloses a lawn and flower bed divider system that uses sections formed from PVC or the like including straight and curved sections. The sections are hollow and contain integral water and electrical wiring conduits. The ends include fittings to interconnect the sections to form a continuous divider. Sprinkler heads are disposed along the divider and connected internally along the divider. Lighting fixtures are installed along the divider and internally connected to wiring in the wiring conduits. The water conduits are connected to a water source and the wiring is connected to a low voltage power source.

Cagne, U.S. Pat. No. 5,499,170 discloses a lighting track for use in public transportation vehicles that comprises an outer track having upstanding walls connected together by a base portion, together defining a first retention channel. The upstanding walls have a downwardly facing first barrier portion. A receptacle has first and second side walls connected together by a spanning portion, together defining a second retention channel. The side walls have an upwardly facing second barrier portion, and a downwardly facing third barrier portion. When the receptacle is in place in the first retention channel, the first and second side walls are each selectively movable between a respective locking position where the second barrier portion is in intimate engagement with the first barrier portion and a respective unlocking position where the second barrier portion is removed from intimate engagement with the first barrier portion. A top cover has first and second side walls connected together by a lens. The side walls have an upwardly facing fourth barrier portion. A lighting element is disposed between the receptacle and the top cover. When the protective top cover is in place in the second retention channel of the receptacle and the receptacle is in place in the first retention channel of the outer track, the first and second barrier portions intimately engage each other in interfering relation, and the third and fourth barrier portions intimately engage each other in interfering relation, so as to lock the receptacle within the outer track and to lock the protective top cover within the receptacle.

Crevier, U.S. Pat. No. 6,065,853 discloses a driveway, walkway and landscape lighting assembly. The assembly has an elongated main tube body formed of PVC with hollow parallel support tubes underneath the body for allowing water in the body to seep into the ground. A hollow box with outwardly flared sides sits on top of the main body. A lens cover such as, but not limited to, a glass brick or plastic brick sits on top of the box.

Conway, U.S. Pat. No. 6,123,443 discloses an apparatus and method of lighted ground curbing, flatwork and other structures having a recessed channel formed therein for receiving a length of flexible sheathed lighting. The separately sheathed lighting is adequately protected independent of the curbing, flatwork or other structure, and is powered by a power source residing separately and independently of the curbing, to thereby eliminate any need for electrical sockets or protective covering to be included as part of the curbing or flatwork portion. The lighting operates to project a substantially continuous stream of light extending continuously along the recess formed in the curbing, flatwork or other structure.

Rhodes, U.S. Pat. No. 6,354,714 discloses an embedded LED lighting system for marking flooring, walkways, roadways, and airport runways employs a strip of light emitting diode mounted on a I-beam shaped framework and encapsulated in a clear or reflective potting material. The upper portion of the housing for the LED lighting system is covered with a reflective coating or tape. The embedded LED lighting system can be controlled by motion sensors, pressure sensors, or crosswalk lights.

Szymanski, U.S. Pat. No. 6,699,137 discloses a method of adapting a golf course for playing golf at night using a glow-in-the-dark golf ball includes selecting an elongated flexible light source and placing it around the perimeter of a golf course putting green, fairway, bunkers, and other hazards and anchoring the placed elongated flexible light source to the earth with anchoring stakes. The golf hole may have the rim illuminated and may have a night visible flag. The selected and placed elongated flexible light source is partially buried to provide a smooth surface thereover. The elongated flexible light source, such as a plurality of light emitting diodes (LEDS), may be placed in a flexible transparent polymer tube or channel and may be an electro-illuminescent wire or incandescent bulbs or LED spaced within a polymer tube or an elongated fiberoptic lighted from one end.

The present invention is distinguished over the prior art in general, and these patents in particular by a rope light track system that houses a tubular flexible rope light string and can be mounted on or in various interior and exterior structures to protect the light string from damage and provide utilitarian and decorative lighting. The system includes a plurality of elongate rigid or semi-rigid tracks having a longitudinal generally rectangular U-shaped retention channel with an open end defined by laterally opposed side walls adjoined at one end by a transverse base wall and at least one retainer element near the open end. The tracks have side portions or a mounting flange portion extending outwardly from the retention channel to accommodate various mounting configurations. An elongate tubular flexible rope lighting string is removably mounted in the retention channel and retained therein to prevent accidental removal, and is disposed below the channel open end to protect it from being damaged and allow light emanating therefrom to be directed out of the channel open end. Various control devices control the illuminating operation of the rope light string.

SUMMARY OF THE INVENTION

It is therefore an object of the present invention to provide a rope light track system for mounting tubular flexible rope light strings on a generally flat surface, which is easily and quickly installed.

It is another object of this invention to provide a rope light track system that houses a tubular flexible rope light string for providing interior and exterior structures with utilitarian and aesthetic decorative lighting effects.

Another object of this invention is to provide a rope light track system that houses a tubular flexible rope light string, that will protect and prevent the light string from being crushed by the wheel of a vehicle, from being stepped on, from becoming twisted or deformed, and prevent damage to the light emitting elements and short circuiting of the interior wiring.

Another object of this invention is to provide a rope light track system that houses a tubular flexible rope light string that may be easily and quickly installed on a wide variety of interior and exterior structures, such as in or on a concrete driveway or walkway, along baseboards, on stairways and handrails, under cabinets and countertops, and on boat docks.

A further object of this invention is to provide a rope light track system that houses a tubular flexible rope light string that can be controlled by an on-off switch, a timer, a dimmer, a motion detector, or a light sensor.

A still further object of this invention is to provide a rope light track system that houses a tubular flexible rope light string, which is simple in construction, inexpensive to manufacture and is safe, rugged and reliable in operation.

Other objects of the invention will become apparent from time to time throughout the specification and claims as hereinafter related.

The above noted objects and other objects of the invention are accomplished by a rope light track system that houses a tubular flexible rope light string and can be mounted on or in various interior and exterior structures to protect the light string from damage and provide utilitarian and decorative lighting. The system includes a plurality of elongate rigid or semi-rigid tracks having a longitudinal generally rectangular U-shaped retention channel with an open end defined by laterally opposed side walls adjoined at one end by a transverse base wall and at least one retainer element near the open end. The tracks have side portions or a mounting flange portion extending outwardly from the retention channel to accommodate various mounting configurations. An elongate tubular flexible rope lighting string is removably mounted in the retention channel and retained therein to prevent accidental removal, and is disposed below the channel open end to protect it from being damaged and allow light emanating therefrom to be directed out of the channel open end. Various control devices control the illuminating operation of the rope light string.

DESCRIPTION OF THE PREFERRED EMBODIMENTS

As used herein, the terms "flexible tubular light string" and "rope light string" mean a lighting assembly having a light emitting source encased in an elongate hollow flexible translucent tube. It should also be understood that the light emitting source encased in the flexible tube may be, but not limited to, a plurality of closely spaced electrically connected miniature light bulbs or light emitting diodes (LED's) to form elongate strings, or elongate side-lit fiber optic cable. The rope light track system includes a plurality of tracks that may be installed end-to-end on a wide variety of interior and exterior structures and in which an elongate rope light string is removably mounted to provide utilitarian and aesthetic decorative lighting effects.

Figures 1, 2:
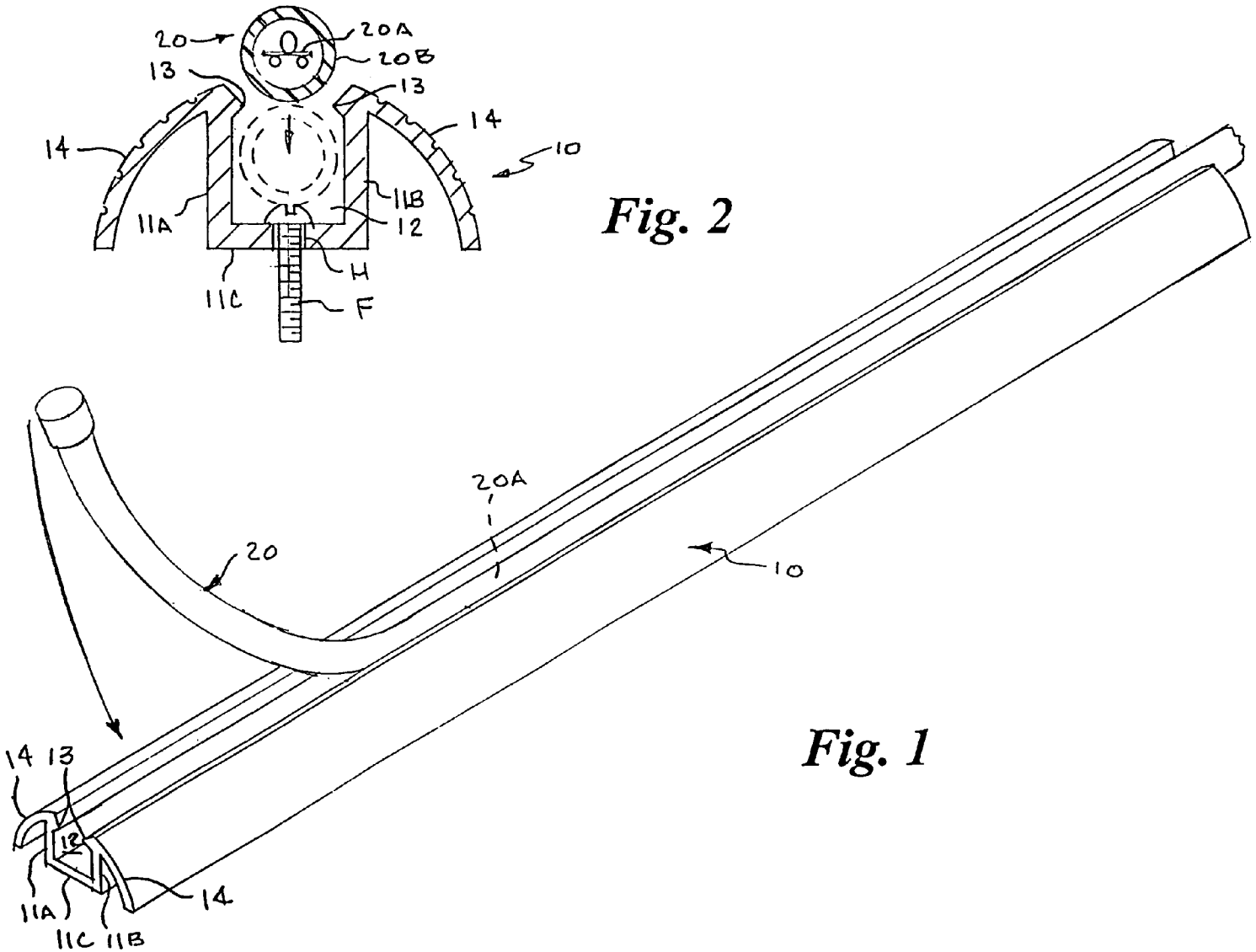
FIG. 1 is a perspective view of a first embodiment of the lighting track in accordance with the present invention having a generally arcuate cross sectional profile.
FIG. 2 is a transverse cross sectional view of the first embodiment of the track in larger scale, showing, somewhat schematically, a tubular flexible rope lighting string being installed in the retention channel.

Referring now to FIGS. 1 and 2 of the drawings by numerals of reference, there is shown a first embodiment of a track member 10 having first and second parallel laterally spaced side walls 11A, 11B, each adjoined at a first end by a transverse base wall 11C defining a longitudinal generally rectangular U-shaped retention channel 12 having an open end. The retention channel 12 is of sufficient size to accommodate an elongate section of a tubular flexible rope light string 20.

The flexible rope light string 20 has a light emitting source 20A encased in a flexible translucent tube 20B. The light emitting source 20A may be, but not limited to, a plurality of closely spaced electrically connected miniature light bulbs or light emitting diodes (LED's) to form elongate strings, or elongate side-lit fiber optic cable. Such rope light strings are commercially available from a wide variety of sources, and are well known in the art, therefore the particular interior wiring and circuitry are represented schematically and not shown and described in detail.

In a preferred embodiment, a short protrusion 13 is formed on each of the side walls 11A and 11B near a second end disposed in laterally opposed spaced relation. The protrusions 13 are spaced apart a distance sufficiently less than the outer diameter of the tubular flexible rope light string 20, such that when the flexible rope light string 20 is pressed into the channel 12 it is forced past the protrusions 13 and thereafter is releasably retained therein by the protrusions to prevent accidental removal. When installed in the channel 12, the section of the tubular flexible rope light string 20 is disposed therein at a sufficient depth to protect it from damage and allow light emanating therefrom to be directed out of said channel open end. Although two protrusions 13 are shown, it should be understood that a single protrusion may be formed on only one side wall for releasably retaining the tubular flexible rope light string 20 in the channel 12.

For purposes of example, the protrusions 13 are shown to have a generally V-shaped profile, however, they may also be of other configurations, such as a rounded bead. It should also be understood, that other types of retaining means may be provided on at least one of the side walls near a second end for releasably retaining the section of tubular flexible rope light string therein.

Each track has at least one flange portion extending outwardly from the retention channel 12 which is dimensioned and configured to accommodate mounting the track in differing, predetermined mounting configurations. In the embodiment of FIGS. 1 and 2, the flange portion is a pair of arcuate side portions 14 each having a first end adjoined to a respective one of the laterally spaced side walls 11A and 11B and curving laterally outward and downward from the open end of the retention channel 12 in laterally opposed relation and terminating in a second end disposed in a plane substantially flush with a bottom surface of the transverse base wall 11C.

The tracks 10 are preferable formed by extrusion and, depending upon the particular application, may be formed of rigid, semi-rigid, malleable or bendable metal or plastic material. For example, for outdoor use, such as forming a border along the sides of a driveway, or walkway, the tracks may be formed of extruded aluminum; and for interior use, they may be formed of a suitable plastic material.

The track embodiment of FIGS. 1 and 2 is particularly suited for outdoor use, and may be mounted onto a flat surface by drilling holes H through the base wall 11C at longitudinally spaced locations and installing fasteners F through the holes into the supporting surface. Alternatively, the tracks 10 may be embedded in a concrete slab. The track may also be installed on the supporting surface by affixing the base wall 11C to the supporting surface by adhesive, epoxy or double-sided adhesive tape, or other conventional fastening means.

Figure 3:
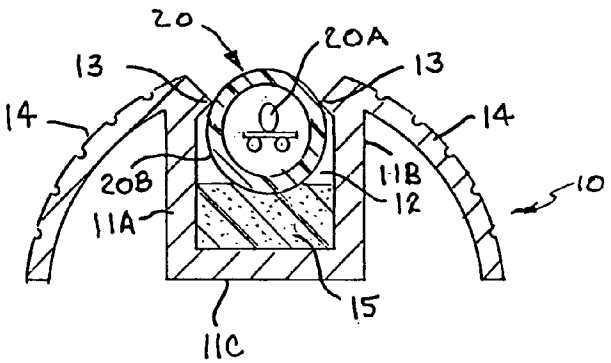
FIG. 3 is a transverse cross sectional view of the first embodiment of the track showing, somewhat schematically, a tubular flexible rope lighting string installed in the retention channel on a strip of resilient material disposed in the bottom of the channel.

As shown in FIG. 3, a strip of resilient material 15 may be disposed on an inner facing surface of the transverse base wall 11C for supporting and maintaining the section of the tubular flexible rope light string 20 near the open end of the retention channel 12 in engagement with the protrusions 13 with an outer circumferential segment of the rope light string tube 20A disposed generally flush with an outer or top surface of the said track. The resilient strip 15 may be formed of cellular foam materials or other suitable cushioning materials.

Figure 4:
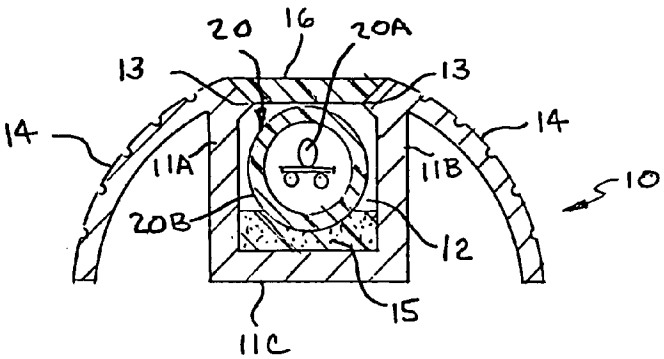
FIG. 4 is a transverse cross sectional view of the first embodiment of the track, showing a cover member installed over the open end of the retention channel.

Optionally, as shown in FIG. 4, an elongate longitudinal generally rectangular cover member 16 formed of rigid or semi-rigid transparent or translucent material may be mounted above the protrusions 13 between the laterally spaced side walls 11A and 11B and disposed generally flush with an outer or top surface of the track 10. It should be understood that the tracks in accordance with the present invention may be provided with both, the cover member 16 and the resilient strip 15, as shown in FIG. 4, with only the resilient strip 15, as shown in FIG. 3, or with neither as shown in FIG. 2.

Figure 5:
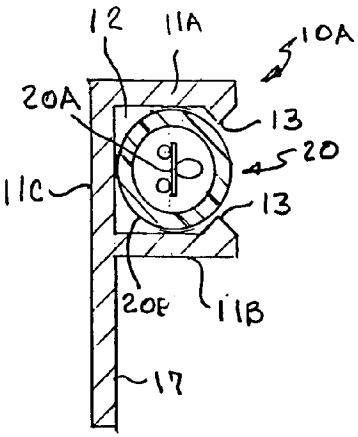
FIG. 5 is a transverse cross sectional view of a second embodiment of the lighting track, which has a generally F-shaped transverse cross sectional configuration.

Referring now to FIG. 5, there is shown in transverse cross section, an embodiment of the lighting track 10A, which has a generally F-shaped transverse cross sectional configuration. The elements that are the same as previously described above are assigned the same numerals of reference, but their detailed description will not be described again here to avoid repetition. In this embodiment, the flange portion is an elongate longitudinal generally rectangular flange portion 17 having a first end adjoined to one of the laterally spaced side walls 11B and extending perpendicularly outward therefrom in a plane substantially parallel with the transverse base wall 11C, wherein the retention channel 12 is disposed perpendicular to the flange portion 17 with its open end facing outwardly therefrom. The flange portion 17 serves as a mounting flange, and may be mounted onto a flat surface by drilling holes through the flange portion at longitudinally spaced locations and installing fasteners through the holes into the supporting surface, or by affixing it to the supporting surface by adhesive, epoxy or double-sided adhesive tape, or other conventional fastening means.

Figure 6:
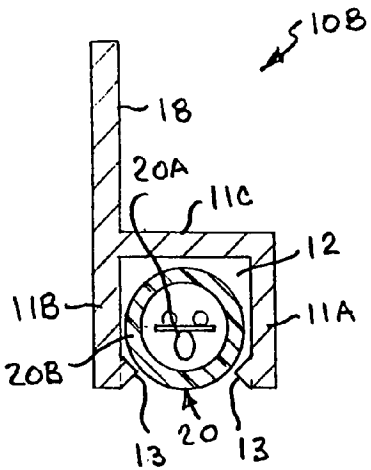
FIG. 6 is a transverse cross sectional view of a third embodiment of the lighting track, which has a generally h-shaped transverse cross sectional configuration.

FIG. 6 shows, in transverse cross section, an embodiment of the lighting track 10B, which has a generally h-shaped transverse cross sectional configuration. The elements that are the same as previously described above are assigned the same numerals of reference, but their detailed description will not be described again here to avoid repetition. In this embodiment, the flange portion is an elongate longitudinal generally rectangular flange portion 18 having a first end adjoined to the transverse base wall 11C and extending perpendicularly outward therefrom in a plane substantially parallel to one of the laterally spaced side walls 11B, wherein the retention channel 12 is disposed generally parallel to the flange portion 18 with its open end facing in opposed relation to the flange portion. The flange portion 18 serves as a mounting flange, and may be mounted onto a flat surface by drilling holes through the flange portion at longitudinally spaced locations and installing fasteners through the holes into the supporting surface, or by affixing it to the supporting surface by adhesives, epoxy or double-sided adhesive tape, or other conventional fastening means.

Figure 7:
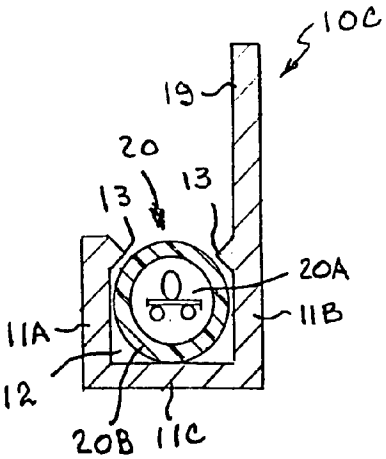
FIG. 7 is a transverse cross sectional view of a fourth embodiment of the lighting track, which has a generally squared J-shaped transverse cross sectional configuration.

FIG. 7 shows, in transverse cross section, an embodiment of the lighting track 10C, which has a generally squared J-shaped transverse cross sectional configuration. The elements that are the same as previously described above are assigned the same numerals of reference, but their detailed description will not be described again here to avoid repetition. In this embodiment, the flange portion is an elongate longitudinal generally rectangular flange portion 19 having a first end adjoined to one of the laterally spaced side walls 11B forming an extension thereof, wherein the retention channel 12 disposed generally parallel to the flange portion with its open end facing in the same direction as the flange portion. As with the previous embodiments, the flange portion 19 serves as a mounting flange, and may be mounted onto a flat surface by drilling holes through the flange portion at longitudinally spaced locations and installing fasteners through the holes into the supporting surface, or by affixing it to the supporting surface by adhesives, epoxy or double-sided adhesive tape, or other conventional fastening means.

It should be understood that the embodiments of FIGS. 5, 6 and 7 may be provided with a resilient strip 15 disposed on an inner facing surface of the transverse base wall 11C, as shown and described with reference to FIG. 3, and/or an elongate longitudinal generally rectangular cover member 16, as shown and described with reference to FIG. 4.

Figure 8:
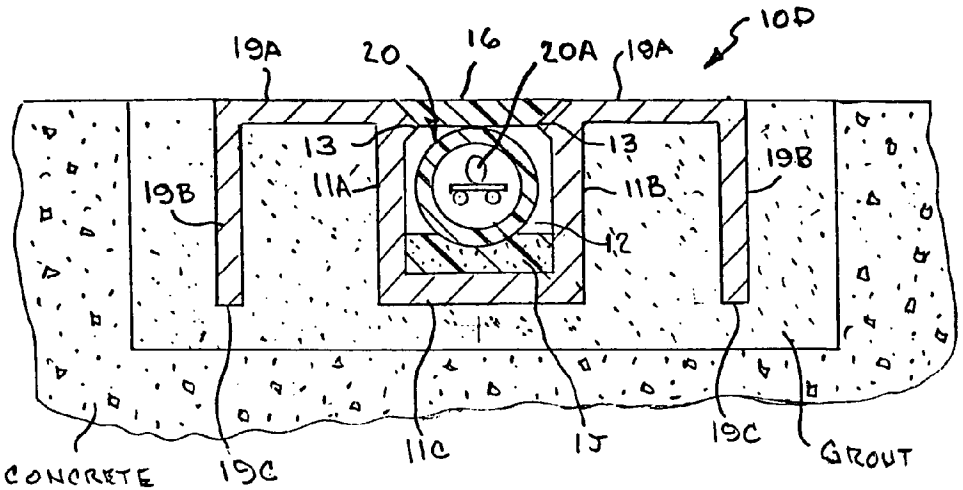
FIG. 8 is a transverse cross sectional view of a fifth embodiment of the lighting track, which is mounted flush in a concrete surface.

Referring now to FIG. 8, there is shown in transverse cross section, an embodiment of the lighting track 10D, which is particularly suited for flush mounting in a concrete slab. The elements that are the same as previously described above are assigned the same numerals of reference, but their detailed description will not be described again here to avoid repetition. In this embodiment, a pair of straight side portions 19A each having a first end adjoined to a respective one of the laterally spaced side walls 11A and 11B extend perpendicularly outward from the open end of the retention channel 12 in laterally opposed relation and adjoin a straight downwardly extending portion 19B disposed in parallel outwardly spaced relation to the side walls 11A and 11B and terminate in a second end 19C disposed in a plane substantially flush the bottom surface of the transverse base wall 11C. In the illustrated example, the concrete slab is provided with a channel which is filled with grout and the track 10D is embedded in the grout.

Figure 9:
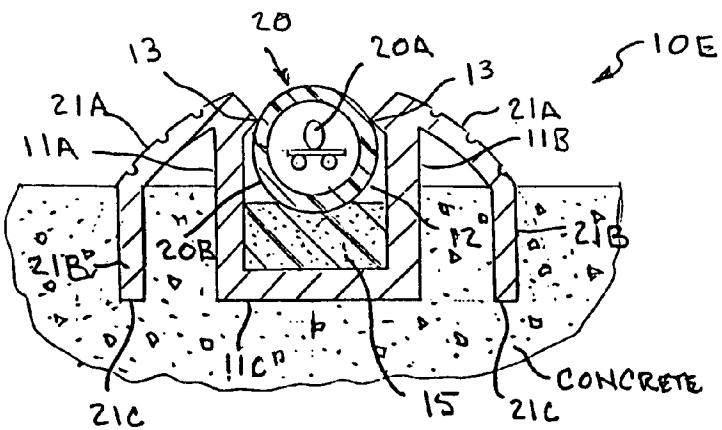
FIG. 9 is a transverse cross sectional view of a sixth embodiment of the lighting track, which is mounted in a concrete surface and has an upper segment above the concrete surface.

Referring now to FIG. 9, there is shown in transverse cross section, another embodiment of the lighting track 10E, which is mounted in a concrete slab, but has an upper portion that protrudes above the slab. The elements that are the same as previously described above are assigned the same numerals of reference, but their detailed description will not be described again here to avoid repetition. In this embodiment, a pair of side portions 21A each having a first end adjoined to a respective one of the side walls 11A and 11B extend outwardly and downwardly from the open end of the retention channel 12 in laterally opposed relation and adjoin a straight downwardly extending portion 21B disposed in parallel outwardly spaced relation to the side walls 11A and 11B terminating in a second end 21C disposed in a plane substantially flush with the bottom surface of the transverse base wall 11C.

The light emitting source 20A of the rope light string 20 may be powered by alternating current, DC current, or solar power, and the illuminating operation of the rope light string may be controlled by an off switch, an LED controller, a voltage transformer, a timer, a dimmer, a motion detector, a light sensor or combinations thereof.

Although the light track has been illustrated, for purposes of example, as being straight, it should be understood that the tracks may be curved along their length, or my be mitered by cutting with a convention saw to fit the particular surfaces on which they are to be installed.

While this invention has been described fully and completely with special emphasis upon preferred embodiments, it should be understood that within the scope of the appended claims the invention may be practiced otherwise than as specifically described herein.

The invention claimed is:

1. A rope light track system for mounting a tubular flexible rope light string on or in a generally flat surface, comprising:

at least one elongate rigid or semi-rigid track having first and second parallel laterally spaced side walls each adjoined at a first end by a transverse base wall defining a longitudinal generally rectangular U-shaped retention channel having an open end, said retention channel being of sufficient size to accommodate an elongate section of a tubular flexible rope light string;

at least one flange portion on said track extending outwardly from said retention channel dimensioned and configured to facilitate mounting said track in differing, predetermined mounting configurations;

a short longitudinally extending protrusion on each of said side walls near said channel open end disposed in laterally opposed spaced relation and spaced apart a distance sufficiently less than the diameter of the section of the tubular flexible rope light string to be installed in said retention channel such that the section of the flexible rope light string is forced past said protrusions into said retention channel and thereafter releasably retained therein by said protrusions to prevent accidental removal and at a sufficient depth to protect the section of the tubular flexible rope light string from damage and allow light emanating therefrom to be directed out of said channel open end; and a strip of resilient cushioning material disposed on an inner facing surface of said transverse base wall for resiliently supporting the section of the tubular flexible rope light string in said retention channel and resiliently biasing the tubular flexible rope light string into engagement with said laterally opposed protrusions such that an outer circumferential segment of the rope light string is disposed generally flush with an outer surface of said track.

2. The rope light track system according to claim 1, further comprising:

an elongate longitudinal generally rectangular cover member formed of rigid or semi-rigid transparent material removably mounted above said laterally opposed protrusions between said first and second parallel laterally spaced side walls and disposed generally flush with an outer surface of said track.

3. The rope light track system according to claim 1, wherein said at least one flange portion comprises an elongate longitudinal generally rectangular flange portion having a first end adjoined to one of said laterally spaced side walls and extending perpendicularly outward therefrom in a plane substantially parallel with said transverse base wall, wherein said track has a generally F-shaped transverse cross sectional configuration with said retention channel disposed perpendicular to said flange portion and said retention channel open end facing outwardly therefrom;

said flange portion functioning as a mounting flange for mounting said track onto a flat surface such that said retention channel is disposed perpendicular to the flat surface and light emanating from the section of the flexible rope light string is directed out of said channel open end in a direction perpendicular to the flat surface.

4. The rope light track system according to claim 1, wherein said at least one flange portion comprises an elongate longitudinal generally rectangular flange portion having a first end adjoined to one of said laterally spaced side walls forming an extension thereof, wherein said track has a generally squared J-shaped transverse cross sectional configuration with said retention channel disposed generally parallel to said flange portion and said retention channel open end facing in the same direction as said flange portion;

said flange portion functioning as a mounting flange for mounting said track onto a flat surface such that said retention channel is disposed parallel to the flat surface and light emanating from the section of the flexible rope light string is directed out of said channel open end parallel to the flat surface in the same direction as said flange portion.

5. The rope light track system according to claim 1, wherein said at least one flange portion comprises an elongate longitudinal generally rectangular flange portion having a first end adjoined to said transverse base wall and extending perpendicularly outward therefrom in a plane substantially parallel to one of said laterally spaced side walls, wherein said track has a generally h-shaped transverse cross sectional configuration with said retention channel disposed generally parallel to said flange portion and said retention channel open end facing in opposed relation to said flange portion;

said flange portion functioning as a mounting flange for mounting said track onto a flat surface such that said retention channel is disposed parallel to the flat surface and light emanating from the section of the flexible rope light string is directed out of said channel open end parallel to the flat surface in a direction opposite said flange portion.

6. The rope light track system according to claim 1, wherein said at least one flange portion comprises a pair of straight side portions each having a first end adjoined to a respective one of said laterally spaced side walls and extending perpendicularly outward from said retention channel open end in laterally opposed relation and adjoining a straight downwardly extending portion disposed in parallel outwardly spaced relation to said laterally spaced side walls terminating in a second end disposed in a plane substantially flush with a bottom surface of said transverse base wall;

said straight side portions and adjoining straight downwardly extending portions functioning as mounting surfaces for embedding said track in concrete or grout such that said retention channel open end is disposed generally flush with a top surface of the concrete or grout.

7. The rope light track system according to claim 1, wherein said at least one flange portion comprises a pair of side portions each having a first end adjoined to a respective one of said laterally spaced side walls and curved outwardly and downwardly from said retention channel open end in laterally opposed relation and adjoining a straight downwardly extending portion disposed in parallel outwardly spaced relation to said laterally spaced side walls terminating in a second end disposed in a plane substantially flush with a bottom surface of said transverse base wall;

said outwardly curved side portions and adjoining straight downwardly extending portions functioning as mounting surfaces for embedding said track in concrete or grout such that said retention channel open end is disposed a distance above a top surface of the concrete or grout.

8. The rope light track system according to claim 1, further comprising:

an elongate tubular flexible rope light string resiliently supported in said retention channel on said strip of resilient cushioning material and resiliently biased into engagement with said protrusions, said rope light string comprising a light emitting source encased in a hollow flexible translucent tube and connected with an electrical power source;

said light emitting source selected from the group consisting of a plurality of closely spaced electrically connected miniature light bulbs or light emitting diodes, and elongate side-lit fiber optic cable.

9. The rope light track system according to claim 5, further comprising:

control means connected with said power source and said light emitting source for controlling the illuminating operation of said rope light string;

said control means selected from the group consisting of an on-off switch, an LED controller, a voltage transformer, a timer, a dimmer, a motion detector, and a light sensor and combinations thereof.

10. The rope light track system according to claim 1, wherein said track is made of an extruded material selected from the group consisting of rigid, semi-rigid, malleable, and bendable materials.

11. A rope light track system for mounting a tubular flexible rope light string on or in a generally flat surface, comprising:

at least one elongate rigid or semi-rigid track having first and second parallel laterally spaced side walls each adjoined at a first end by a transverse base wall defining a longitudinal generally rectangular U-shaped retention channel having an open end, said retention channel being of sufficient size to accommodate an elongate section of a tubular flexible rope light string, and a pair of arcuate side portions each having a first end adjoined to a respective one of said laterally spaced side walls and curving laterally outward and downward from said retention channel open end in laterally opposed relation and terminating in a second end disposed in a plane substantially flush with a bottom surface of said transverse base wall;

a short longitudinally extending protrusion on each of said side walls near said channel open end disposed in laterally opposed spaced relation and spaced apart a distance sufficiently less than the diameter of the section of the tubular flexible rope light string to be installed in said retention channel such that the section of the flexible rope light string is forced past said protrusions into said retention channel and thereafter releasably retained therein by said protrusions to prevent accidental removal and at a sufficient depth to protect the section of the tubular flexible rope light string from damage and allow light emanating therefrom to be directed out of said channel open end; and a strip of resilient cushioning material disposed on an inner facing surface of said transverse base wall for resiliently supporting the section of the tubular flexible rope light string in said retention channel and resiliently biasing the tubular flexible rope light string into engagement with said laterally opposed protrusions such that an outer circumferential segment of the rope light string is disposed generally flush with an outer surface of said track;

said track being mounted on a support surface with an outer surface of said transverse base wall affixed to the support surface with said second ends of said arcuate side portions engaged on the support surface such that said retention channel is disposed perpendicular to the support surface and light emanating from the section of the flexible rope light string is directed out of said channel open end in a direction perpendicular to the support surface.

* * * * *